United States Patent [19]

Woodrow et al.

[11] Patent Number: 4,537,055

[45] Date of Patent: Aug. 27, 1985

[54] SINGLE STRAND BLOCK-TYPE ROLLING MILL

[75] Inventors: Harold E. Woodrow, Northboro; Raymond L. Smola, Holden, both of Mass.

[73] Assignee: Morgan Construction Company, Worcester, Mass.

[21] Appl. No.: 622,543

[22] Filed: Jun. 20, 1984

[51] Int. Cl.[3] ..... B21B 35/02

[52] U.S. Cl. ..... 72/235; 72/249; 248/676

[58] Field of Search ..... 72/235, 237, 238, 249, 72/455; 248/676, 678

[56] References Cited

U.S. PATENT DOCUMENTS

| | | | |
|---|---|---|---|
| 3,336,781 | 8/1967 | Wilson et al. | 72/235 |
| 3,613,428 | 10/1971 | Townsend et al. | 72/237 |
| 3,945,234 | 3/1976 | Steinbock | 72/235 |

FOREIGN PATENT DOCUMENTS

| | | | |
|---|---|---|---|
| 1110115 | 7/1961 | Fed. Rep. of Germany | 72/237 |
| 827341 | 2/1960 | United Kingdom | 72/249 |

*Primary Examiner*—Lowell A. Larson
*Assistant Examiner*—Jorji M. Griffin
*Attorney, Agent, or Firm*—Thompson, Birch, Gauthier & Samuels

[57] ABSTRACT

A single strand rolling mill has successive pairs of work rolls arranged to roll rod and bar products in a twist-free manner. The work rolls are carried on roll shafts included as part of roll packages which are detachably mounted to gear housings, and the gear housings contain intermediate drive shafts and intermeshed gears connected via line shaft segments and intermeshed bevel gears to a primary mill drive. The gear housings are carried on a base which is made up of a flat vertically upstanding structural member standing on edge and joined to an underlying base plate. The structural member extends beneath and in parallel relationship to the rolling line. Rib members extend laterally away from and are spaced along opposite sides of the structural member. The rib members are joined on edge to both the structural member and the base plate and have upper support edges on which the gear housings are secured.

8 Claims, 7 Drawing Figures

SINGLE STRAND BLOCK-TYPE ROLLING MILL

BACKGROUND OF THE INVENTION

1. Field of the Invention

This invention relates generally to rolling mills, and is concerned in particular with an improved single strand block-type mill for rolling products such as bars, rods and the like in a twist-free manner.

2. Description of the Prior Art

Typical examples of conventional mills of the type referred to above are shown in U.S. Pat. Nos. Re 28,107 (Wilson et al) and 3,610,014 (Weber). In these mills, the successive roll stands, which each include a bevel gear housing carrying a removable roll package, are located on a common side of the rolling line. This requires a rather complicated and heavy base structure which adds significantly to the overall cost of the mill.

Other mill designs, such as for example those described in German Pat. No. 970,102 (granted 21 Aug. 1958) and in the September 1958 issue of Iron and Steel Engineer at pages 65–67, have opted for a different "X" type arrangement, where successive mill stands are alternatively arranged on opposite sides of the rolling line. These mills mount the roll stands on the sloping faces of an inverted V-shaped support pedestal. Some cost savings can be achieved with this type of base structure. However, other problems, including lack of vertical and longitudinal compactness, lack of sufficient structural rigidity, and a high noise level attributable to sound reverberation within the enclosed space underlying the support pedestal, more than offset any cost saving, thereby rendering such designs impractical for most commercial applications.

SUMMARY OF THE INVENTION

An objective of the present invention is the provision of a single strand block-type mill having an improved base structure which is lower in cost as compared with other conventional base structures now in widespread use.

A companion objective of the present invention is the achievement of the aforesaid cost saving without sacrificing compactness and structural rigidity, and with an attendant significant abatement of noise level.

These as well as other objectives and advantages to be described hereinafter in more detail, stem from the incorporation into the mill design of a base which includes a flat vertically upstanding center plate welded on edge to an underlying horizontal base plate, thereby forming an inverted "T" structure underlying and extending in parallel relationship to the rolling line. A plurality of rib plates extend laterally away from and are spaced along both sides of the center plate. The rib plates are welded on edge to both the center and base plates. By constructing the base structure as a weldment of flat center, base and rib plates, significant reductions in overall weight and cost can be realized, without sacrificing structural rigidity. Adjacent pairs of rib plates cooperate with the center and base plates in defining bays which open both upwardly and laterally of the base structure. The upper edges of the rib plates are machined to define support surfaces on which the bevel gear housings are mounted. The base portions of the bevel gear housings protrude downwardly into the aforesaid bays, thereby enhancing the vertical compactness of the overall mill structure. In addition, the base portions of successive bevel gear housings alternately arranged on opposite sides of the center plate partially overlap each other in the direction of rolling, thereby enhancing the longitudinal compactness of the mill structure. The open bays minimize sound reverberation, resulting in a noticeable reduction in operating noise level.

A preferred embodiment of the invention will now be described in more detail with reference to the accompanying drawings.

DESCRIPTION OF PREFERRED EMBODIMENT

Figure 1:
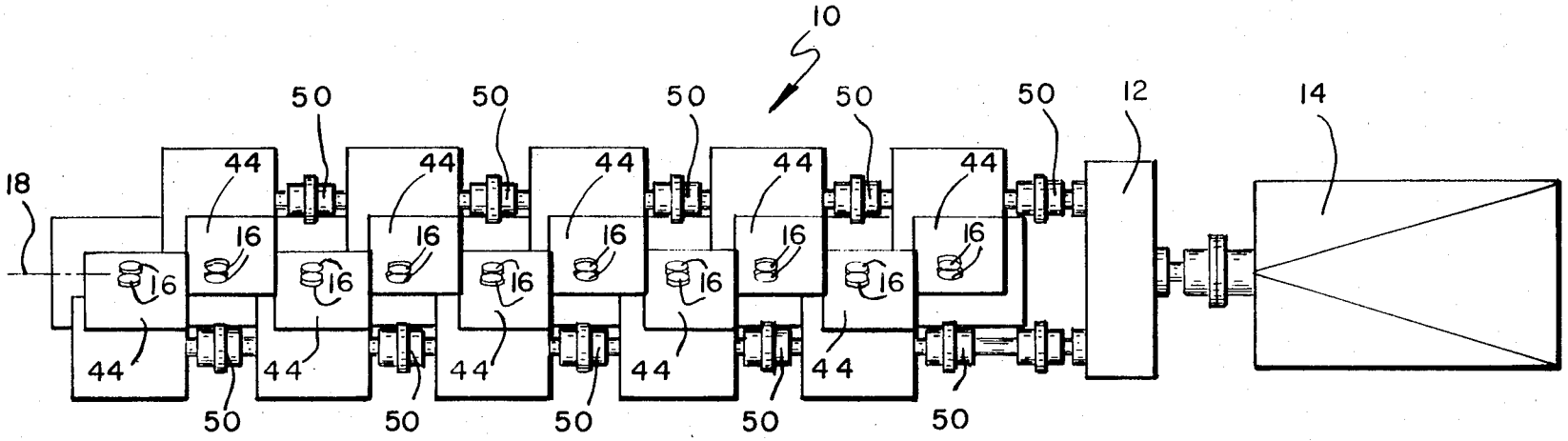
FIG. 1 is a somewhat schematic plan view on a reduced scale of a single strand block-type mill installation in accordance with the present invention.

Referring initially to FIG. 1, a rolling mill in accordance with the present invention is shown at 10. The mill is connected via a conventional gear-type speed increaser 12 to a primary drive motor 14.

With reference to the remaining drawings, it will be seen that the mill 10 has successive pairs of "cantilevered" or "overhung" work rolls 16 arranged along the rolling line 18. The roll axes of successive roll pairs are offset by 90° to thereby allow the product to be rolled in a twist free manner.

Figure 7:
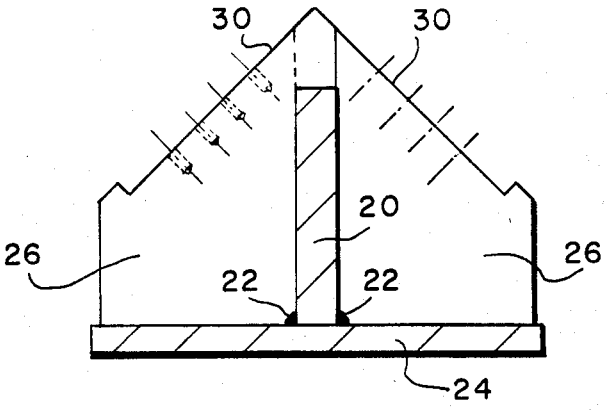
FIG. 7 is a sectional view taken along line 7—7 of FIG. 3.

The mill has a base which includes an upstanding structural member in the form of a flat center plate 20 welded on edge as at 22 (see FIG. 7) to an underlying horizontal base plate 24. The center and base plates 20, 24 form an inverted "T" shaped cross section. The center plate 20 extends beneath and in parallel relationship to the rolling line 18.

Figure 2:
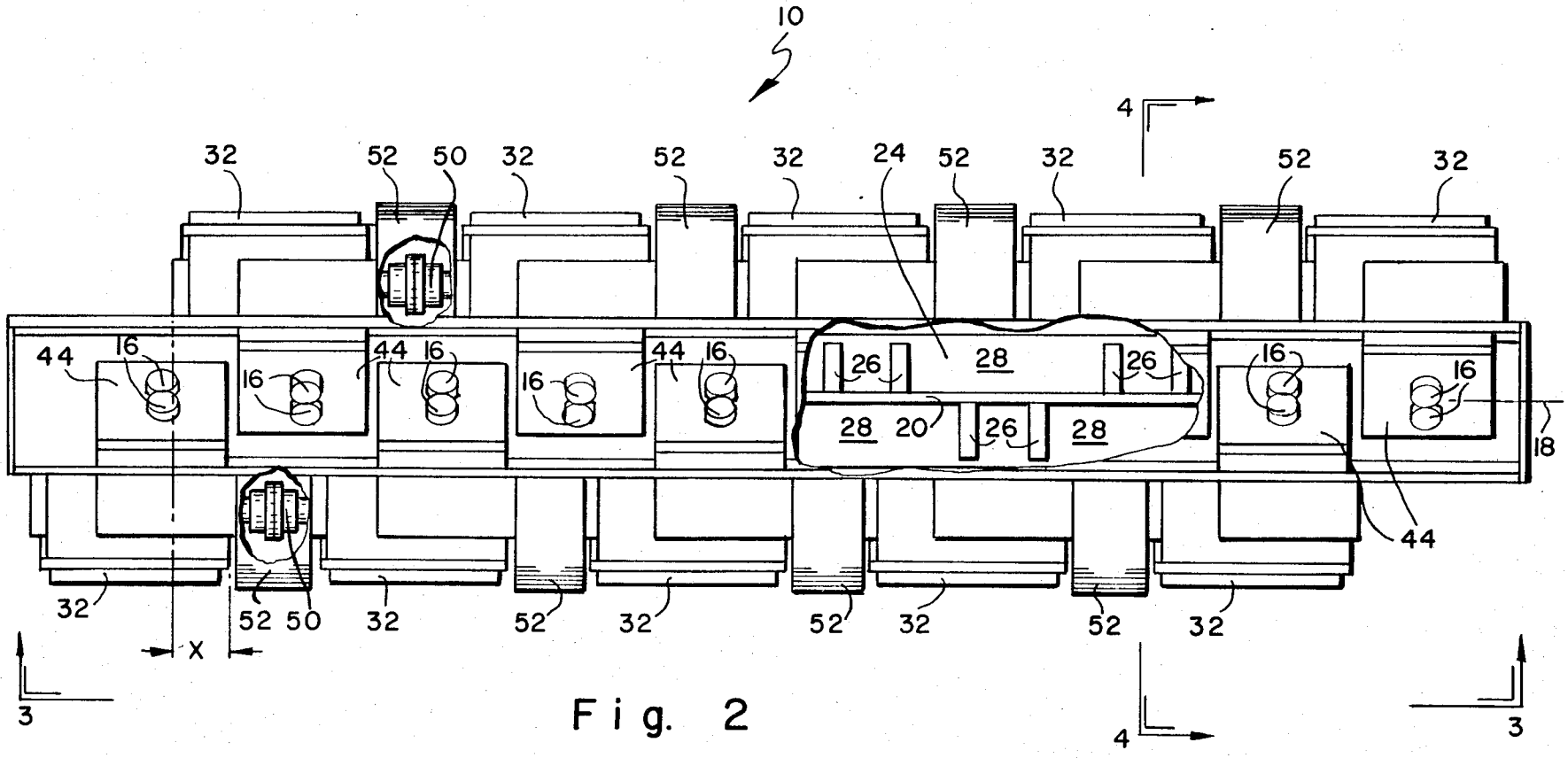
FIG. 2 is a plan view on an enlarged scale of a portion of the mill installation shown in FIG. 1 (excluding the speed increaser and primary drive motor), with portions broken away to better show the underlying base structure.
Figure 3:
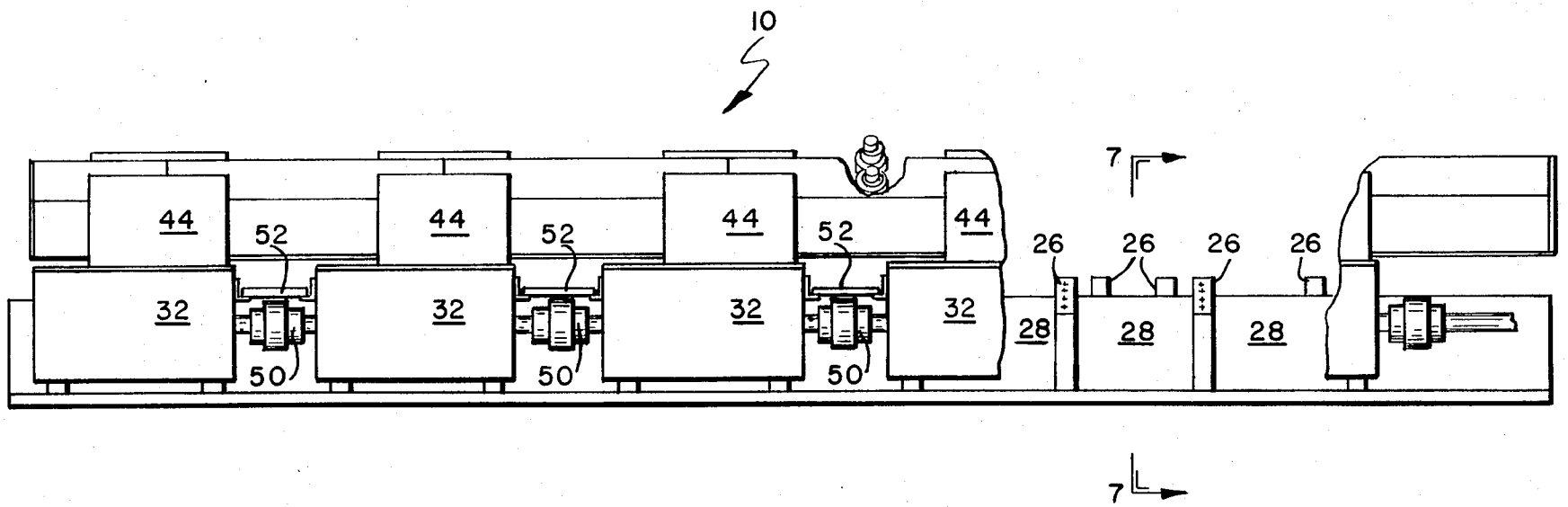
FIG. 3 is a side view of the mill shown in FIG. 2, again with portions broken away to show the base structure.
Figure 4:
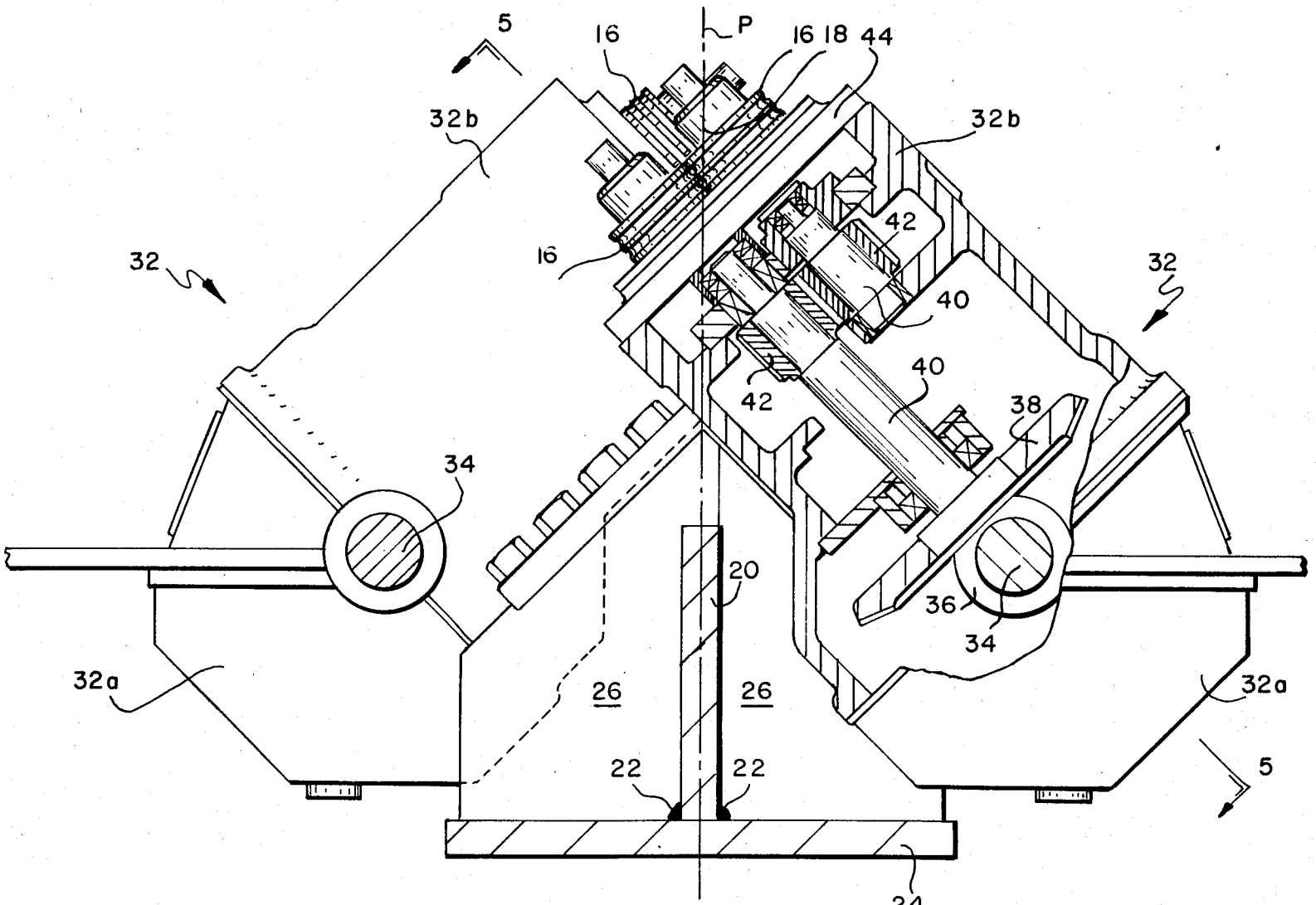
FIG. 4 is a sectional view on an enlarged scale taken along line 4—4 of FIG. 2.
Figure 5:
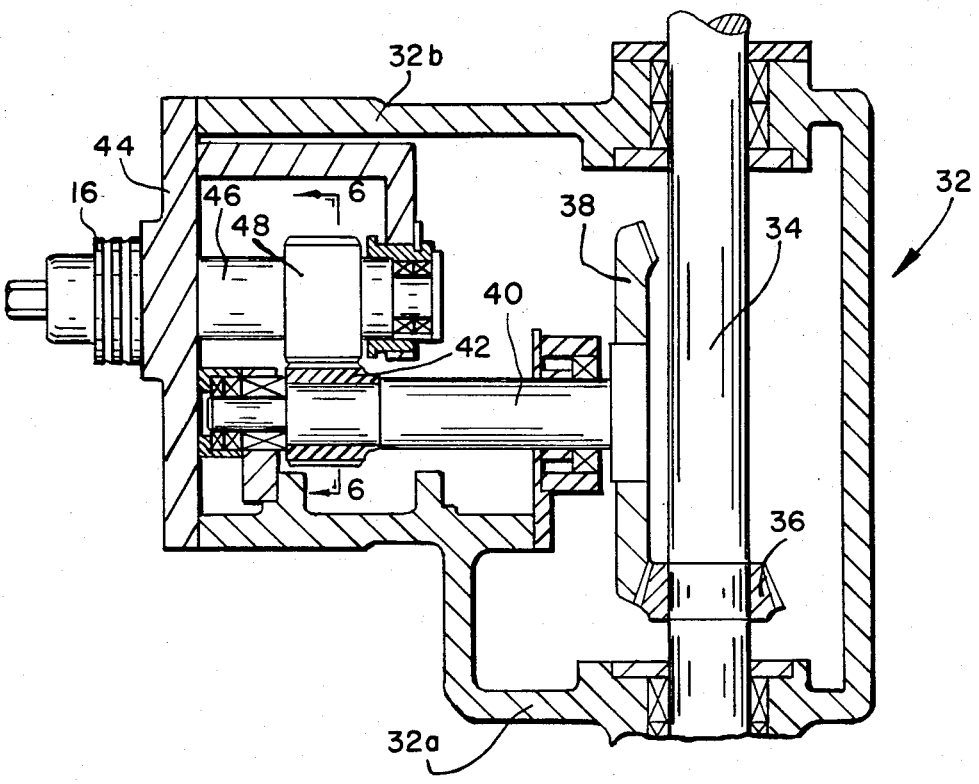
FIG. 5 is a sectional view taken along line 5—5 of FIG. 4.

Rib plates 26 are welded on edge at spaced intervals along the base to both the center and base plates 20, 24. The rib plates strengthens the overall structure, and also cooperate in pairs with the center and base plates in defining open bays 28 which lie on opposite sides of the center plate, and which overlap each other in the rolling direction. As can best be seen in FIG. 7, the rib plates have machined upper support edges 30 which are inclined downwardly and away with respect to a reference plane "P" containing both the center plate 20 and the rolling line 18. Gear housings 32 are arranged successively along the rolling line 18. The gear housings have lower portions **32*a* alternatively arranged on opposite sides of the center plate 20. FIGS. 3 and 4 show that these lower gear housing portions protrude downwardly into the bays 28, thereby contributing to the vertical compactness of the mill. By the same token, as shown in FIG. 2**, the same lower gear housing portions 32*a* partially overlap each other, as illustrated for example at "x", thereby contributing to the compactness of the mill in the direction of rolling.

The upper portions 32*b* of the gear housings overlie the center plate 20 and are carried on and secured to the inclined upper support edges 30 of the rib plates 26. The overlap of the lower gear housing portions 32*a* assists in achieving a close spacing between the upper gear housing portions 32*b*, which is beneficial in that it minimizes the distance between successive pairs of work rolls 16.

Each gear housing 32 contains a line shaft segment 34 carrying a driving bevel gear 36 which meshes with a driven bevel gear 38 on one of a pair of intermediate driven shafts 40. The intermediate drive shafts carry intermeshed gears 42.

Figure 6:
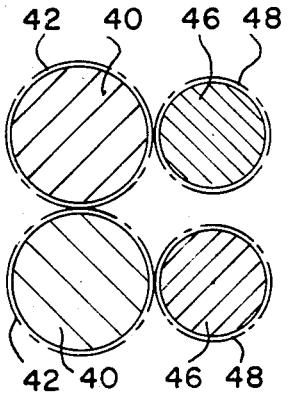
FIG. 6 is a sectional view taken along line 6—6 of FIG. 5.

Roll packages 44 are carried by the gear housings 32. Preferably, the roll packages are at least partially received within the upper gear housing portions 32*b*. Each roll package has a pair of roll shafts 46 on which the work rolls 16 are mounted. The roll shafts each carry gears 48 which are separated from each other, and which mesh individually with the intermeshed gears 42 on the intermediate drive shafts 40, all as shown in FIG. 6. Although not shown, it will be understood that means similar to that shown in U. S. Pat. No. RE 28,107 (Wilson, et al) are provided for adjusting the parting between the work rolls of each pair.

The line shaft segments 34 are interconnected by couplings 50 underlying removable floor plates 52 which extend between the lower gear housing portions 32*a*. The interconnected line shaft segments are driven via the speed increaser 12 by the primary drive motor 14.

In light of the foregoing, it will now be appreciated by those skilled in the art that the base structure of the present invention embodies important advantageous features not provided by prior art arrangements. For example, a significant reduction in weight and cost is achieved through the use of flat center, base and rib plates. The resulting integral weldment has ample strength and rigidity.

Only the inclined upper support edges 30 of the rib plates 26 need be accurately machined, and this can be done after the base structure has been completely fabricated and heat treated. This makes it possible to accurately align the successive gear housings.

The nesting of the lower gear housing portions 32*a* in the bays 28 located between the rib plates 26, and the overlap of the same housing portions in the direction of rolling, contributes to the overall compactness of the mill. This advantage is achieved without complicating access to the overhung work rolls 16. The base structure is "open", i.e., it is without confined spaces or chambers which would reverberate sound and thus contribute to an increased noise level during mill operation.

We claim:

1. A single strand block-type rolling mill having successive pairs of oppositely inclined work rolls arranged to roll products such as bars or rods in a twist-free manner, comprising:

a vertically upstanding structural member joined to an underlying horizontal base plate to form an inverted "T" shaped cross section, said structural member extending beneath and in parallel relationship to the rolling line;

a plurality of rib members extending laterally away from and spaced along said structural member on opposite sides thereof, said rib members being joined on edge to both said structural member and said base plate and having upper support edges;

a plurality of gear housings successively arranged along the rolling line, said gear housings having lower portions alternately arranged on opposite sides of said structural member, each gear housing being carried on and secured to the upper support edges of an adjacent pair of said rib members, said gear housings each containing a line shaft segment with a driving bevel gear which meshes with a driven bevel gear on one of a pair of intermediate drive shafts, said intermediate drive shafts carrying intermeshed gears;

roll packages carried by said gear housings, each roll package having a pair of roll shafts carrying a pair of said work rolls, said roll shafts having gears which mesh with the gears on said intermediate drive shafts;

means for interconnecting the line shaft segments on opposite sides of said structural member; and primary drive means at one end of said structural member for driving said interconnected line shaft segments.

2. The rolling mill of claim 1 wherein said successively arranged gear housings have upper portions which overlie said structural member, and which are spaced along the rolling line.

3. The rolling mill of claim 2 wherein successive gear housings have base portions which partially overlap each other in the rolling direction.

4. The rolling mill of claim 1 wherein the upper support edges of said rib members are inclined in a direction downwardly and away from a reference plane containing said structural member and the rolling line.

5. The rolling mill in accordance with any one of claims 1–4 wherein the base portions of said gear housings protrude downwardly between the rib members on which they are supported.

6. The rolling mill of claim 1 wherein said roll packages are at least partially received within the upper portions of said gear housings, with said roll shafts being arranged in side by side relationship with said intermediate drive shafts.

7. The rolling mill of claim 1 wherein said structural member consists of an elongated flat plate standing on edge on said base plate.

8. In a single strand rolling mill having successive pairs of work rolls arranged to roll rod and bar products in a twist-free manner, the work rolls being carried on roll shafts included as part of roll packages which are detachably mounted to gear housings, and the gear housings containing means connected to a primary mill drive for driving said roll shafts, the improvement comprising: a flat vertically upstanding structural member standing on edge and joined to an underlying base plate, said structural member extending beneath and in parallel relationship to the rolling line, and a plurality of rib members extending laterally away from and spaced along the length of said structural member, said rib members being joined to both said structural member and said base plate and having upper support edges, said gear housings being successively arranged along the rolling line and having base portions alternately arranged on opposite sides of said structural member, each base portion being secured to the upper support edges of an adjacent pair of said rib members.

* * * * *